US008286370B2

(12) United States Patent
Polegato Moretti

(10) Patent No.: US 8,286,370 B2
(45) Date of Patent: Oct. 16, 2012

(54) WATERPROOF VAPOR-PERMEABLE SHOE

(75) Inventor: Mario Polegato Moretti, Crocetta Del Montello (IT)

(73) Assignee: GEOX S.p.A., Montebelluna (IT)

( * ) Notice: Subject to any disclaimer, the term of this patent is extended or adjusted under 35 U.S.C. 154(b) by 685 days.

(21) Appl. No.: 12/307,140

(22) PCT Filed: May 31, 2007

(86) PCT No.: PCT/EP2007/004831
§ 371 (c)(1),
(2), (4) Date: Dec. 31, 2008

(87) PCT Pub. No.: WO2008/003375
PCT Pub. Date: Jan. 10, 2008

(65) Prior Publication Data

US 2009/0188134 A1 Jul. 30, 2009

(30) Foreign Application Priority Data

Jul. 6, 2006 (IT) ..... PD2006A0274

(51) Int. Cl.
*A43B 13/28* (2006.01)

(52) U.S. Cl. ..... 36/12; 36/14

(58) Field of Classification Search ..... 36/14, 12, 36/18, 25 R, 30 R
See application file for complete search history.

(56) References Cited

U.S. PATENT DOCUMENTS

2002/0157278 A1 10/2002 Moretti
2007/0180731 A1* 8/2007 Polegato Moretti ..... 36/14

FOREIGN PATENT DOCUMENTS

| | | | |
|---|---|---|---|
| CN | 1234725 | A | 11/1999 |
| CN | 1366453 | A | 8/2002 |
| JP | 10-179202 | | 7/1998 |
| JP | 11-513582 | | 11/1999 |
| JP | 2000-166606 | | 6/2000 |
| JP | 2005-532106 | | 10/2005 |
| WO | 01 78542 | | 10/2001 |
| WO | WO 2004028284 | A1 * | 4/2004 |
| WO | 2005 063069 | | 7/2005 |
| WO | 2005 070658 | | 8/2005 |

(Continued)

OTHER PUBLICATIONS

U.S. Appl. No. 13/141,530, filed Jun. 22, 2011, Polegato Moretti.

(Continued)

*Primary Examiner* — Ted Kavanaugh
(74) *Attorney, Agent, or Firm* — Oblon, Spivak, McClelland, Maier & Neustadt, L.L.P.

(57) ABSTRACT

A waterproof vapor-permeable shoe, including an upper part that delimits a foot insertion region; a sole, made mainly of plastic material, provided with at least one region which is diffusely perforated with through holes in the direction of a walking surface; a vapor-permeable or perforated flat element, rigidly coupled to the lower part of the sole on which the tread of the sole is formed or rigidly coupled, the flat element adapted to limit the formation of hollows in the foot insertion region at the projection of the holes of the diffusely perforated region; and a waterproof vapor-permeable membrane associated with the upper part and/or with the sole; the membrane being arranged above the flat element so as to be superimposed on the diffusely perforated region.

6 Claims, 8 Drawing Sheets

FOREIGN PATENT DOCUMENTS

| | | |
|---|---|---|
| WO | 2006 010578 | 2/2006 |
| WO | 2007 012415 | 2/2007 |

OTHER PUBLICATIONS

U.S. Appl. No. 13/091,355, filed Apr. 21, 2011, Polegato Moretti, et al.

Office Action issued Nov. 23, 2010, in Chinese Patent Application No. 200780025319.8 (English translation only).

U.S. Appl. No. 13/263,822, filed Oct. 10, 2011, Polegato Moretti.

Japanese Office Action (2009-516928) dated Jul. 17, 2012 (English Translation).

* cited by examiner

WATERPROOF VAPOR-PERMEABLE SHOE

TECHNICAL FIELD

The present invention relates to a shoe of the waterproof and vapor-permeable type.

BACKGROUND ART

It is known that most of the perspiration of the foot originates at the interface between the sole of the foot and the sole of the shoe.

On this interface, most of the sweat is unable to evaporate and accordingly condenses on the plantar insert on which the foot rests; the remaining part of the sweat that does not condense (a very small fraction) evaporates through the upper.

This phenomenon is particularly conspicuous in shoes which have a rubber sole; in these cases, vapor permeation through the sole is in fact prevented completely (in the case of soles with a leather tread, a small percentage of sweat is still able to evaporate through the tread).

In order to solve this problem, shoes with soles which are waterproof and vapor-permeable have now been devised for several years.

Their purpose is to allow the escape of the water vapor produced by the foot with perspiration.

One of these solutions is disclosed for example in U.S. Pat. No. 5,044,096 and EP 382904, which relate to a vapor-permeable sole which consists of two layer-like portions, respectively an upper portion and a lower portion of the sole, which are made of rubber or other synthetic material and are provided with through holes, and in interposing between said portions a membrane which is waterproof and vapor-permeable and is connected perimetrically and hermetically to the two portions so as to not allow water infiltrations.

The need to prevent foreign objects of a certain size from being able to arrange themselves inside the holes, with the possibility of damaging the membrane, forces the use of microperforations in the lower portion provided with the tread; the use of microperforations leads to a reduction of the potential vapor permeation area.

Moreover, the microperforations tend to become clogged easily, consequently reducing the actual vapor permeation area.

One improvement is provided in U.S. Pat. No. 5,983,524 and EP 858270, which disclose a shoe provided with a rubber sole which has through holes and a mid-sole composed of a waterproof vapor-permeable membrane and a layer for protecting the membrane, typically a layer of felt.

Although this invention improves protection against external elements, it forces the use of holes measuring 1.5-2.0 mm, which are spaced enough to avoid compromising the structural strength of the tread.

These solutions are not particularly suitable for the disposal of the large amounts of water vapor that form, with perspiration, inside the shoes of individuals who have higher-than-average perspiration.

Excessive foot perspiration can also occur in the case of extremely hot and humid climates and if shoes are used for sports activities.

DISCLOSURE OF THE INVENTION

The aim of the present invention is to provide a waterproof vapor-permeable shoe which solves the drawbacks observed in known types of shoes.

Within this aim, an important object of the present invention is to provide a waterproof vapor-permeable shoe which allows optimum permeation of the water vapor through the sole and at the same time is resistant to piercing of said sole.

This aim and this and other objects, which will become better apparent hereinafter, are achieved by a waterproof vapor-permeable shoe, characterized in that it comprises:

- an upper portion, which delimits the foot insertion region;
- a sole, made mainly of plastic material, which is provided with at least one region which is diffusely perforated with through holes in the direction of the walking surface;
- a vapor-permeable or perforated flat element, which is rigidly coupled to the lower portion of said sole on which the tread of said sole is formed or rigidly coupled, said flat element being arranged so as to overlap directly said at least one diffusely perforated region and being adapted to limit the formation of hollows in the foot insertion region at the projection of the holes of said at least one diffusely perforated region;
- a waterproof vapor-permeable membrane, which is associated with said upper portion and/or with said sole, is arranged above said flat element so as to be superimposed on said at least one diffusely perforated region, and is joined hermetically along its perimeter to the portion of shoe that surrounds said membrane so as to avoid the rise of liquid from said at least one diffusely perforated region and along the perimetric edge of said membrane within the foot insertion region, means for protection against piercing being associated with said membrane and comprising at least said flat element.

BRIEF DESCRIPTION OF THE DRAWINGS

Further characteristics and advantages of the invention will become better apparent from the description of some preferred but not exclusive embodiments thereof, illustrated by way of non-limiting example in the accompanying drawings, wherein.

In the exemplary embodiments that follow, individual characteristics, given in relation to specific examples, may actually be interchanged with other different characteristics that exist in other exemplary embodiments.

Moreover, it is noted that anything found to be already known during the patenting process is understood not to be claimed and to be the subject of a disclaimer.

WAYS TO CARRYING OUT THE INVENTION

Figure 1:
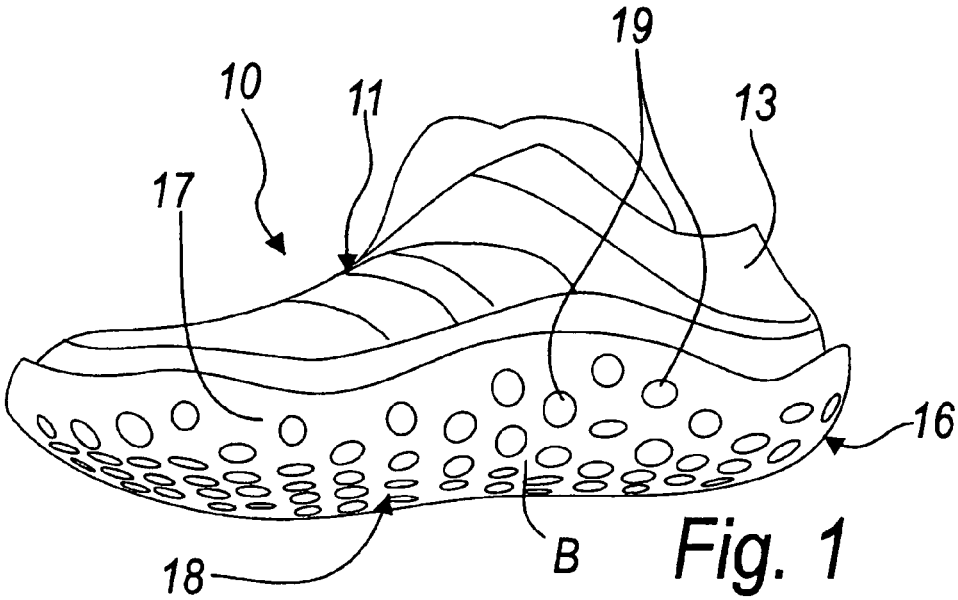
FIG. 1 is a perspective view of a first embodiment of a shoe according to the invention.
Figure 2:
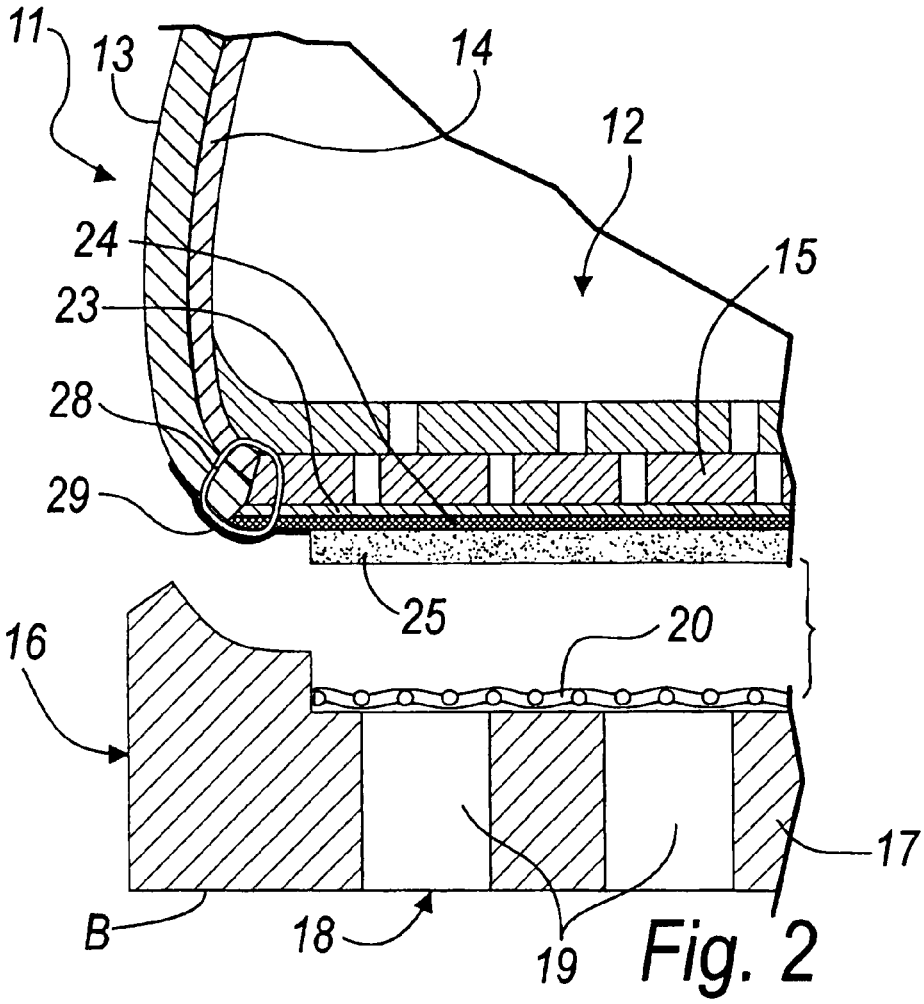
FIG. 2 is a schematic exploded transverse sectional view of the first embodiment of the shoe.
Figure 3:
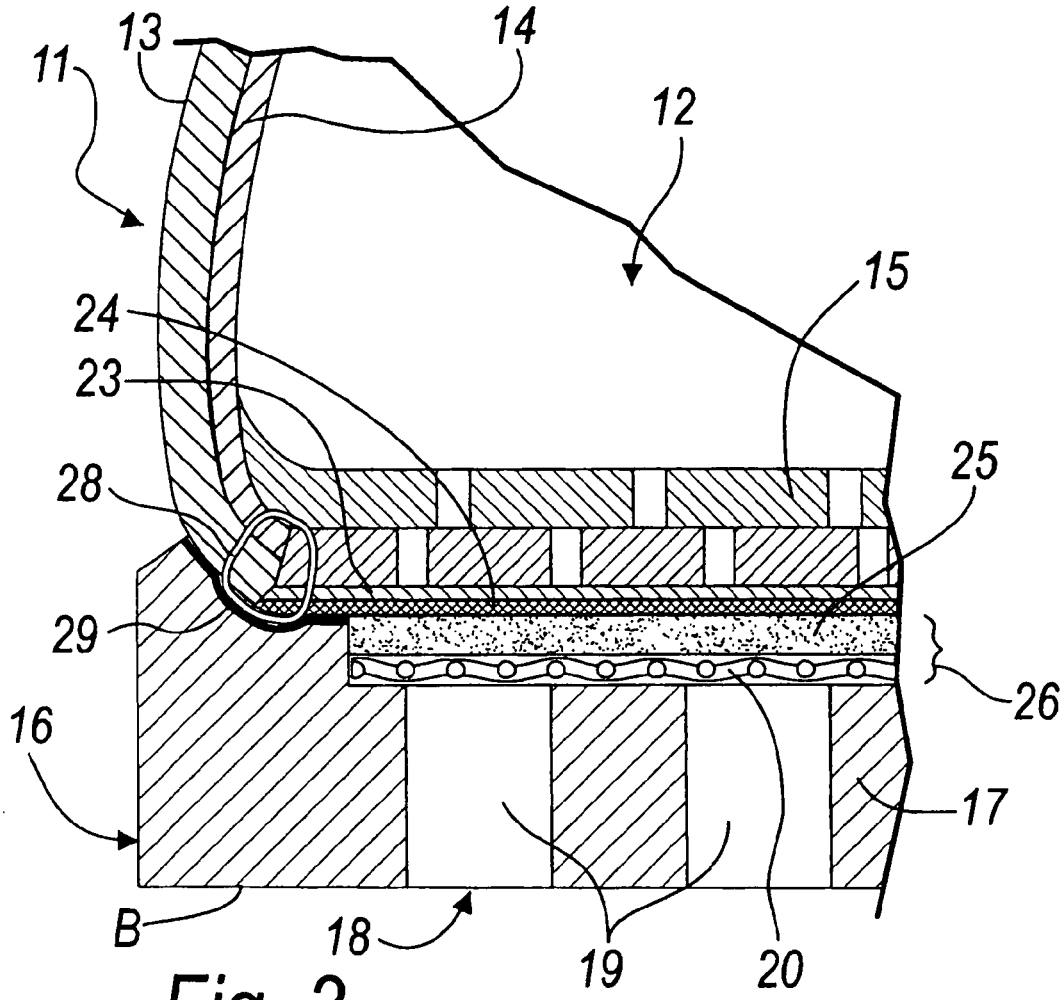
FIG. 3 is a schematic transverse sectional view of the first embodiment of the shoe.

With reference to FIGS. 1, 2 and 3, a first embodiment of a shoe according to the invention is generally designated by the reference numeral 10.

Said shoe 10 comprises an upper portion 11, which delimits the foot insertion region, which is generally designated by the reference numeral 12.

Said upper portion 11 is constituted by an upper 13, which is preferably vapor-permeable (or optionally diffusely perforated with through holes) and is associated with a lining 14, which also is preferably vapor-permeable (or optionally diffusely perforated with through holes), and by an insole 15, which is diffusely perforated with through holes (or optionally vapor-permeable) and is joined to the edges of the upper 13 with the lining 14, for example by means of a construction known as "strobel".

The lining 14 is, for example, joined to the upper 13 by spot gluing, so as to maximize the vapor permeability of the lining-upper assembly.

In other variations, the insole 15 can be joined to the upper by gluing the edges of the upper associated with the lining which are folded back under said insole, according to the construction commonly known as "mounted" or "AGO".

Moreover, the insole can also be constituted by the upper proper, which is sewn in the central part of the sole, according to the construction commonly known as "slip last" (or tubular).

The upper portion 11 is joined to a sole 16, which is mostly made of plastic material and is provided with a diffusely perforated region 18, i.e. with spread out through holes in the direction of the walking surface.

The holes 19 of said diffusely perforated region 18 shown in FIG. 1 are circular and have a diameter of 10 mm.

In accordance with the present invention, the diameter of said holes 19 ranges conveniently from approximately 5 to 20 mm.

In other embodiments, such holes might not be circular and therefore, according to the present invention, the area of said holes ranges conveniently from approximately 19.5 to 315 $mm^2$.

The upper portion 11 and the sole 16 are joined along mutual perimetric bands for example by adhesive bonding (with hydrolysis-resistant adhesives).

Other systems for joining the sole to the upper portion might be high-frequency welding or also the direct injection of the sole on the upper portion.

Advantageously, the sole 16 comprises a flat element 20, which is rigidly coupled to the lower portion 17 of the sole 16, above the tread (designated by the letter B), which is formed or rigidly coupled to said lower portion 17; said flat element 20 is arranged so as to overlap directly the diffusely perforated region 18, thus allowing the passage of water vapor. The term "tread" references the part of the sole that comes into contact with the ground and can be shaped directly on the lower portion 17 of the sole or can be constituted by elements which are rigidly coupled to said lower portion 17.

Said flat element 20 is constituted for example by a net-like structure made of nylon, but it can also be made of metal net or of another material which in any case is resistant to hydrolysis.

Moreover, said flat element 20 can be provided alternately with another structure, such as for example microstretched sheet metal, a layer of leather, fabric made of compressed or not compressed natural fibers (for example hemp or coconut fibers), metallic fibers, synthetic fibers (for example Kevlar), et cetera; in general, said flat element must be vapor-permeable or perforated or in any case must have a structure which allows the passage of water vapor.

The flat element 20 has substantially a dual function.

A first main function is related to limiting the formation of hollows in the foot insertion region 12 at the projection of the holes 19 of the diffusely perforated region 18.

If said flat element 20 were not present, the foot supporting surface would, under the pressure of the foot, be substantially uneven and would form hollows due to the body weight transmitted to the foot, which thus tends "to enter" the holes 19, where it is not supported.

The second function of the flat element 20 is to protect the shoe, in the portion above the holes 19, against piercing on the part of pointed elements which might be trodden upon, as described in greater detail hereinafter.

The shoe 10 also comprises a membrane 23, which is impermeable to water and permeable to water vapor and is superimposed on the diffusely perforated region 18 and prevents the rise of liquids toward the foot insertion region.

In this embodiment, said membrane 23 is associated with the upper portion 11, as shown clearly in the exploded view of FIG. 2; in other embodiments, said membrane can be associated with the sole 16, as described hereinafter.

Said membrane 23 is preferably of the commercially available type, such as for example the ones known by the tradenames Gore-Tex® or Simpatex®.

In this embodiment, said membrane 23 is coupled to a mesh 24 made of synthetic material, which does not compromise its vapor-permeability.

A layer 25 for protecting said membrane against piercing is arranged below the membrane 23 and above the flat element 20 and is made of a material which is resistant to hydrolysis, water-repellent, vapor-permeable or perforated, and made for example of felt or other synthetic material (such as for example Kevlar), metallic material, or even natural material.

The flat element 20 and the protective layer 25 constitute means 26 for protection against piercing for the membrane 23 (it is understood that in other embodiments only the flat element 20 might be present).

The flat element 20 is rigidly coupled to the lower portion 17 of the sole 16, for example by direct injection in a mold of said lower portion 17 onto the flat element.

The membrane 23 is joined perimetrically and hermetically to the portion of the shoe 10 that surrounds said membrane so as to avoid the rise of liquid from the diffusely perforated region 18 and along the perimetric edge of said membrane 23 inside the foot insertion region 12.

In particular, in this embodiment, the membrane 23 with the mesh 24 is spot-glued to the insole 15 (in this version, therefore, the mesh is preferably arranged below the membrane 23); the insole 15, with the membrane 23 and the mesh 24, are thus sewn perimetrically (the stitched seam is designated by the reference numeral 28) to the edges of the assembly constituted by the upper 13 and the lining 14.

In this embodiment, the protective layer 25 is conveniently narrower than the membrane 23 and therefore the edges of said protective layer 25 lie within the contour of said membrane.

The perimetric seal of the membrane 23, generally designated by the reference numeral 29, is superimposed on the stitched seams 28 of the edges of the assembly constituted by the upper 13 and the lining 14 with the insole 15 provided with the membrane 23.

Said seal 29 is provided for example by a perimetric layer of adhesive, which allows the adhesion of the sole 16 to the upper portion 11, or also by depositing a film made of PVC or PU, with a subsequent production of high-frequency welding, which fuses the film and joins the sole 16 and the upper portion 11.

As an alternative, said seal can be provided by the plastic material of the sole by direct injection of said sole onto the upper portion (in this case, the flat element 20 is glued to the membrane 23 before the injection step, or is used as a mold insert and incorporated within the sole during the injection thereof onto the upper portion 11).

Embodiments of shoes according to the invention which are different with respect to the example described above are now described.

Figure 4:
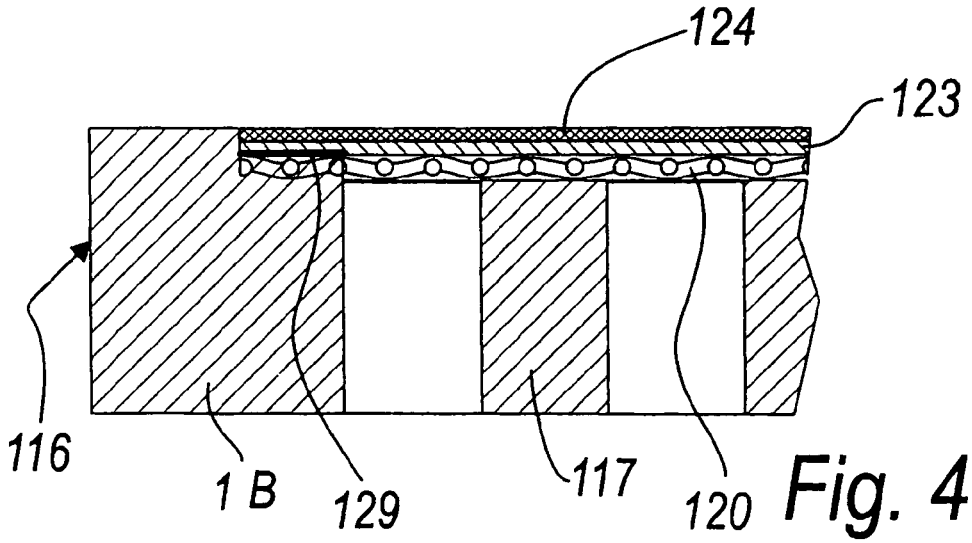
FIG. 4 is a transverse sectional view of a portion of a sole of a shoe according to the invention, related to an embodiment which is alternative with respect to the sole of the shoe of the preceding figures.

FIG. 4 illustrates a portion of a sole of a shoe according to the invention, now generally designated by the reference numeral 116, with which the membrane 123 is associated.

In said sole 116 there is no protective layer for the membrane 123; accordingly, the protection of said membrane is entrusted completely to the flat element 120, which in this embodiment is constituted by a nylon net, but other embodiments are possible according to what has been stated in the preceding example.

The membrane 123 (to which a mesh 124 adheres in an upward region) is for example laminated by spot gluing to the flat element 120 in the contact regions.

The seal 129 is provided for example by means of a perimetric layer of glue, which is spread so as to penetrate through the meshes of the net that constitutes the flat element 120 and join the lower portion 117 of the sole 116 and the membrane 123, or by means of a film made of PVC or PU and by producing high-frequency welding between the lower portion 117 of the sole 116 and the membrane by way of the melting of the film, with penetration thereof among the meshes of the net; in this manner, the lower portion 117 of the sole 116 is rigidly coupled to the flat element 120 and to the membrane 123 and the seal 129 is formed.

Figure 5:
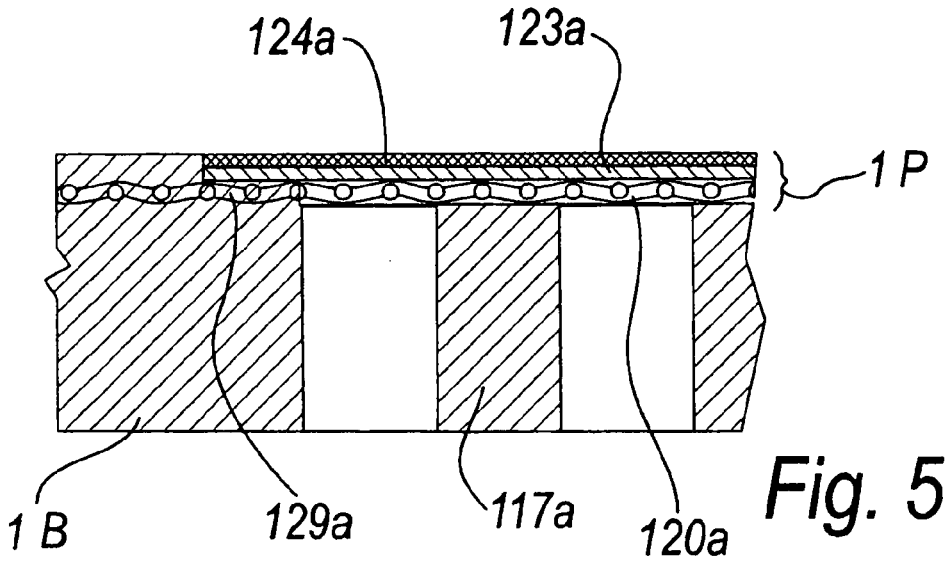
FIG. 5 is a transverse sectional view of a portion of a sole of a shoe according to the invention, which is a variation with respect to the sole of FIG. 4.

FIG. 5 illustrates a variation of the example described above. In this case, the seal, now designated by the reference numeral 129*a*, is constituted for example by the plastic material of the lower portion 117 of the shoe, on which the tread 1B is formed; said tread is overmolded onto a pack (designated by 1P), which is rigidly coupled beforehand by means of adhesive and comprises from the bottom upwardly the flat element 120*a* and the membrane 123*a* with the mesh 124*a*.

The plastic material of the lower portion 117 of the sole 116 passes through the meshes of the net, incorporating them and abutting, so as to form a seal, against the edges of the membrane 123*a*.

With reference to FIGS. 6, 7, 8 and 9, the shoe has a pack 2P which is composed, from the bottom upwardly, of a flat element 220, a protective layer 225, and a membrane 223 (above which a mesh 224 is arranged).

Said pack 2P is locked in a sandwich-like fashion between the lower portion 217 of the sole 216 and an element made of a material which is waterproof, vapor-permeable or perforated at least in the central part and is arranged between said membrane 223 and the insole 215; said element made of waterproof material is superimposed on the region connecting the upper 213 and the insole 215 and is delimited laterally by the lower portion 217 of said sole 216.

Figure 6:
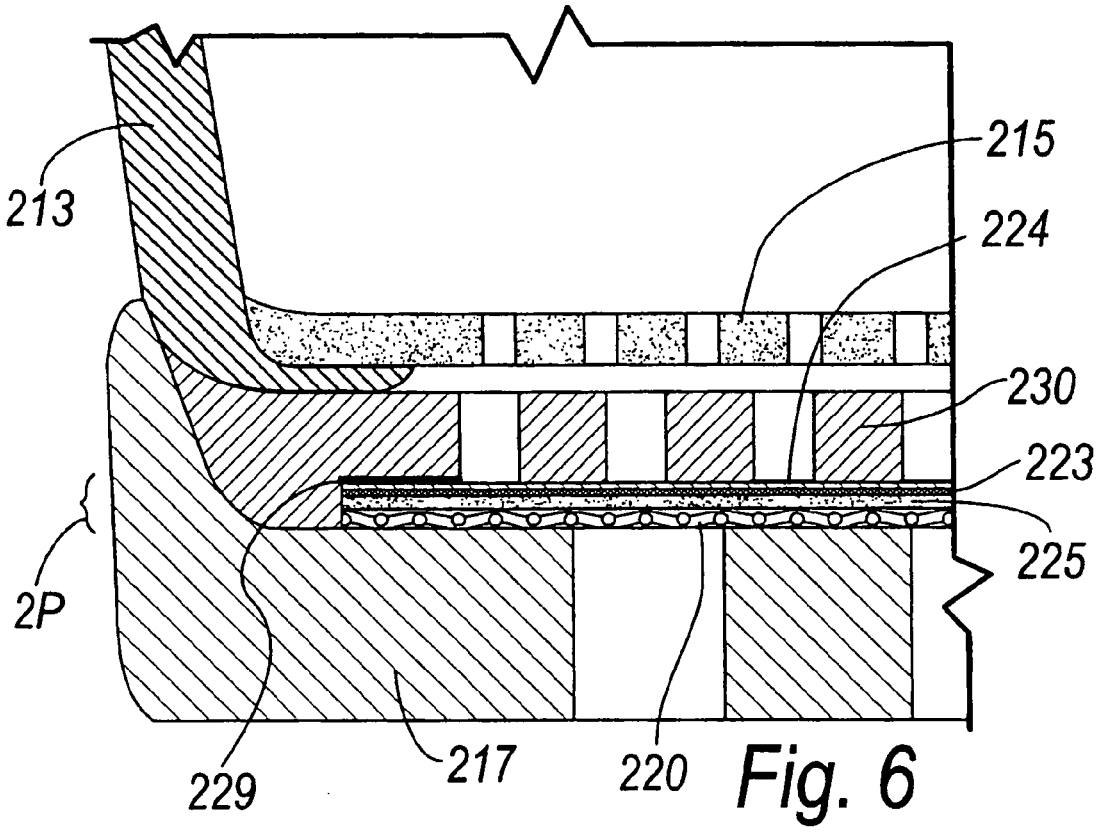
FIGS. 6, 7, 8 and 9 are transverse sectional views of variations of an embodiment of a shoe according to the invention which is alternative with respect to the embodiments of the preceding figures.
Figure 7:
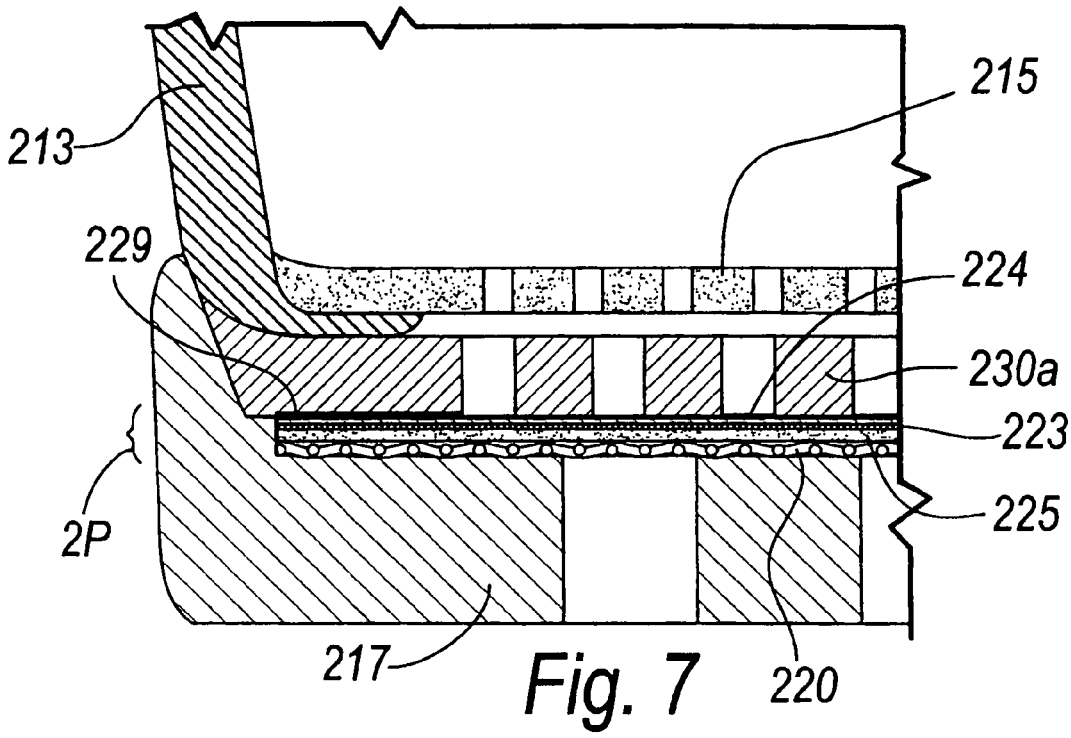
Figure 8:
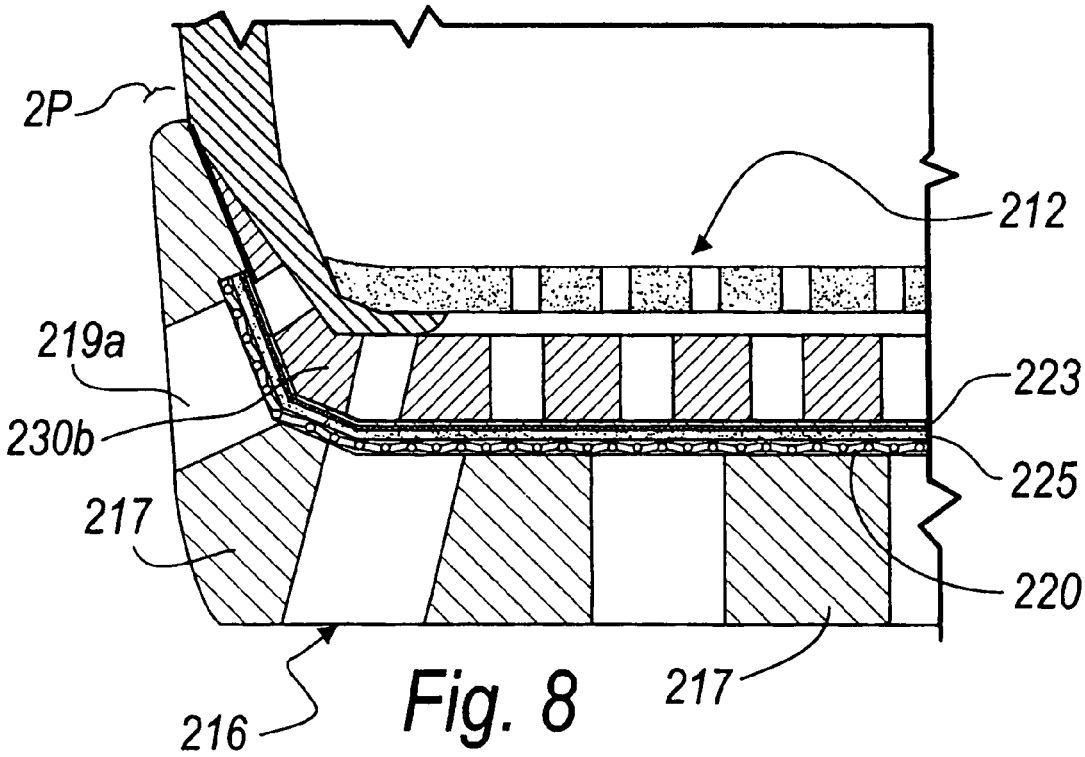
Figure 9:
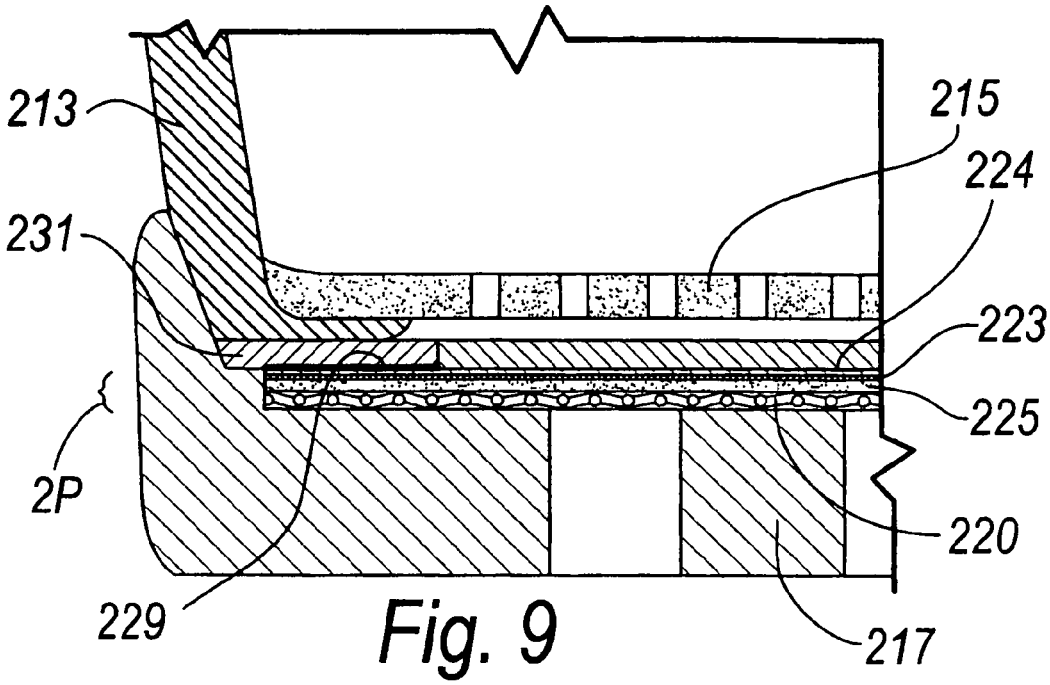

Said element made of a material which is waterproof and vapor-permeable or perforated at least in the central part is for example a diffusely perforated mid-sole, designated by the reference numerals 230 in FIG. 6, 230*a* in FIG. 7 and 230*b* in FIG. 8; as an alternative to the mid-sole, there is an annular bead 231 (at the center of which there is a vapor-permeable filler layer), as shown in FIG. 9.

In the upper perimetric region of the membrane 223 there is the seal 229 between said membrane and the element made of waterproof material (the mid-sole 230, 230*a*, 230*b*, or the bead 231).

Said seal 229 is provided by means of a layer of adhesive, by means of a film melted by high-frequency welding, or by overmolding the mid-sole or the bead on the pack 2P.

In the construction of FIG. 6, the mid-sole 230 surrounds laterally the pack 2P, while in the construction of FIG. 7 the lower portion 217 of the sole 216 surrounds laterally the pack 2P.

With particular reference to FIG. 8, the sole 216 has a lower sole portion 217 which rises laterally on the upper very conspicuously, so as to provide in practice side walls 217*a* which delimit the foot insertion region.

The diffusely perforated region 218 is formed also on said side walls 217*a* in order to allow vapor permeation also in a lateral direction; lateral through holes 219*a* are therefore provided on said side walls.

Accordingly, the flat element 220, the protective layer 225 and the membrane 223 also protrude on said side walls 217*a* so as to be superimposed on the lateral through holes 219*a*.

Figure 10:
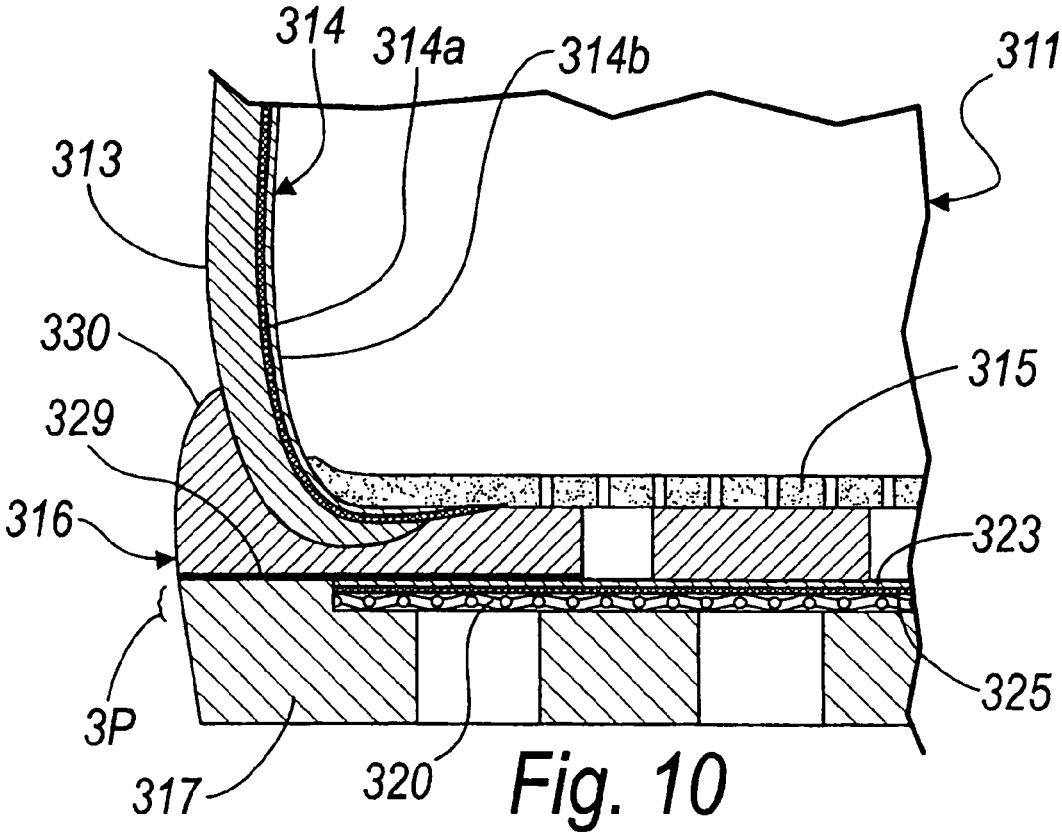
FIG. 10 is a schematic transverse sectional view of an embodiment of a completely waterproof and vapor-permeable shoe, according to the invention, which is a variation with respect to the embodiments of the preceding figures.

With reference to FIG. 10, the sole 316 is provided by means of a double injection molding.

For example, the lower portion 317 of the sole 316 is produced by injection in a first mold.

Subsequently, the lower portion 317 of the sole 316 thus obtained, together with a pack 3P composed of the flat element 320, the protective layer 325 and the membrane 323 (with the mesh bonded thereto in an upward region), are arranged in a second mold and a mid-sole 330 is overmolded which is diffusely perforated in the central part and protrudes laterally with respect to the lower portion 317 of the sole 316, becoming visible.

Said mid-sole 330 produces the perimetric seal 329 on the membrane and on the lower portion 317 of the sole 316 so as to prevent the rise of liquids.

In order to obtain a fully waterproof and vapor-permeable shoe, this example uses, in the construction of the upper portion 311, a composite lining 314, which is formed by an outer layer 314*a* constituted by a waterproof and vapor-permeable membrane, such as the ones that are commercially available, optionally associated with a mesh, and by an inner layer 314*b*, which is directed toward the foot insertion region and is made of leather or vapor-permeable fabric; said lining 314 thus composed is at least 10 mm longer than the upper 313 (in alternative embodiments, the membrane can be associated with the upper and the inner lining can be composed of a single inner layer).

The insole 315 is joined to the upper 313 and to the lining 314 by adhesive bonding of the edges of said upper 313 associated with the lining; said edges are folded under the insole 315, according to the construction commonly known as "mounted" or "AGO".

Waterproofing of the perimetric region is achieved by welding the membrane of the lining, which is exposed, as it is longer than the upper, directly onto the sole.

As an alternative, it is possible to inject directly the plastic material of the upper layer of the sole onto the assembly, by providing a central vapor-permeable or perforated filler element, so as to seal by direct injection the lower portion of the sole, the membrane of the lining and the membrane associated with the lower sole portion.

Figure 11:
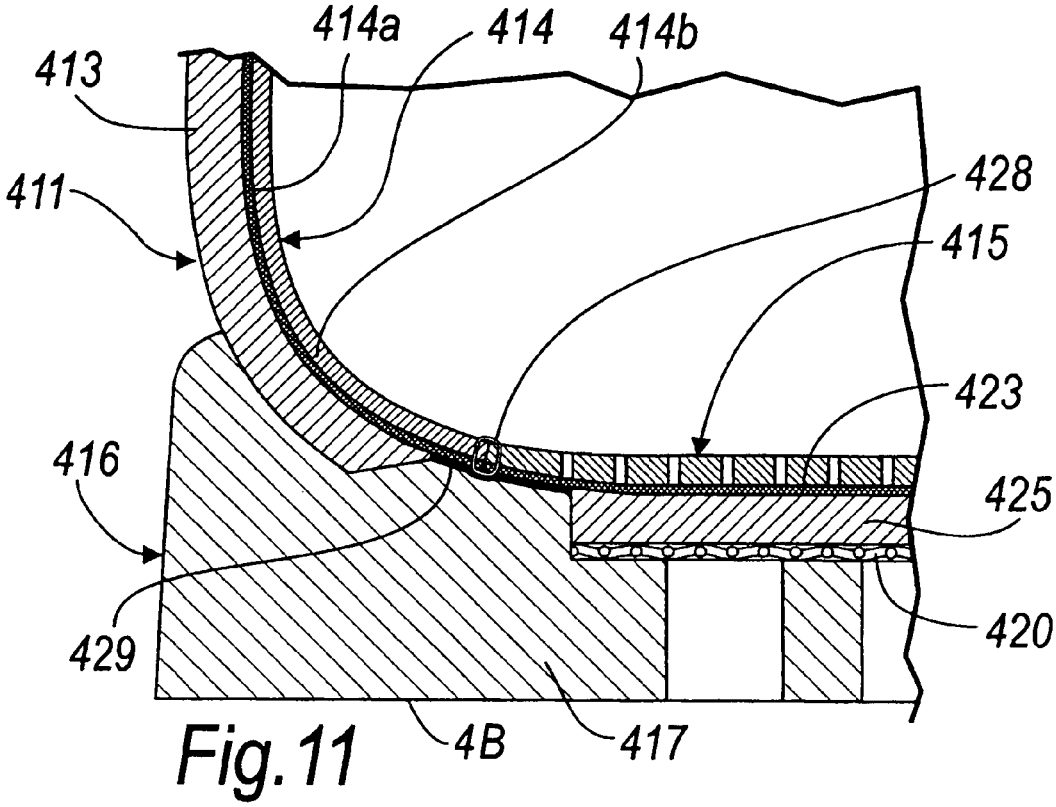
FIG. 11 is a schematic transverse sectional view of a portion of a completely waterproof and vapor-permeable shoe, according to the invention, which is a variation with respect to the embodiments of the preceding figures.

Another embodiment of a completely waterproof and vapor-permeable shoe is shown in FIG. 11.

In this shoe, the upper portion 411 has the lining 414, which is composed of an outer layer 414*a* constituted by a membrane, which is waterproof and vapor-permeable like those of the examples described earlier and is associated with a mesh (not shown in the figure), and by an inner vapor-permeable layer 414*b*, which is directed toward the foot insertion region.

Below the insole 415, which is perforated (or optionally vapor-permeable), a waterproof and vapor-permeable membrane 423 (such as the one of the preceding examples) is fixed by spot gluing; said assembly constituted by the insole 415 and the membrane 423 is joined by means of stitched seams 428 to the edges of the lining 414, according to the construction known commonly as "strobel".

The vapor-permeable upper 413 is glued to the outer layer 414*a* (membrane) of the lining 414.

A vapor-permeable protective layer 425 and, below said layer, the flat element 420, are associated below the assembly constituted by the insole 415 and the membrane 423; the edges of element 420 are internal with respect to the edges of the assembly constituted by the insole 415 and the membrane 423.

The sole 416 (which is monolithic with the lower portion 417 on which the tread 4B is provided) made of plastic material, is then injected, rigidly coupling itself to the flat element 420 and to the upper portion 411, generating a waterproof seal 429 particularly on the membrane 423 which is associated with the insole 415, at the "strobel" stitch 428.

Figure 12:
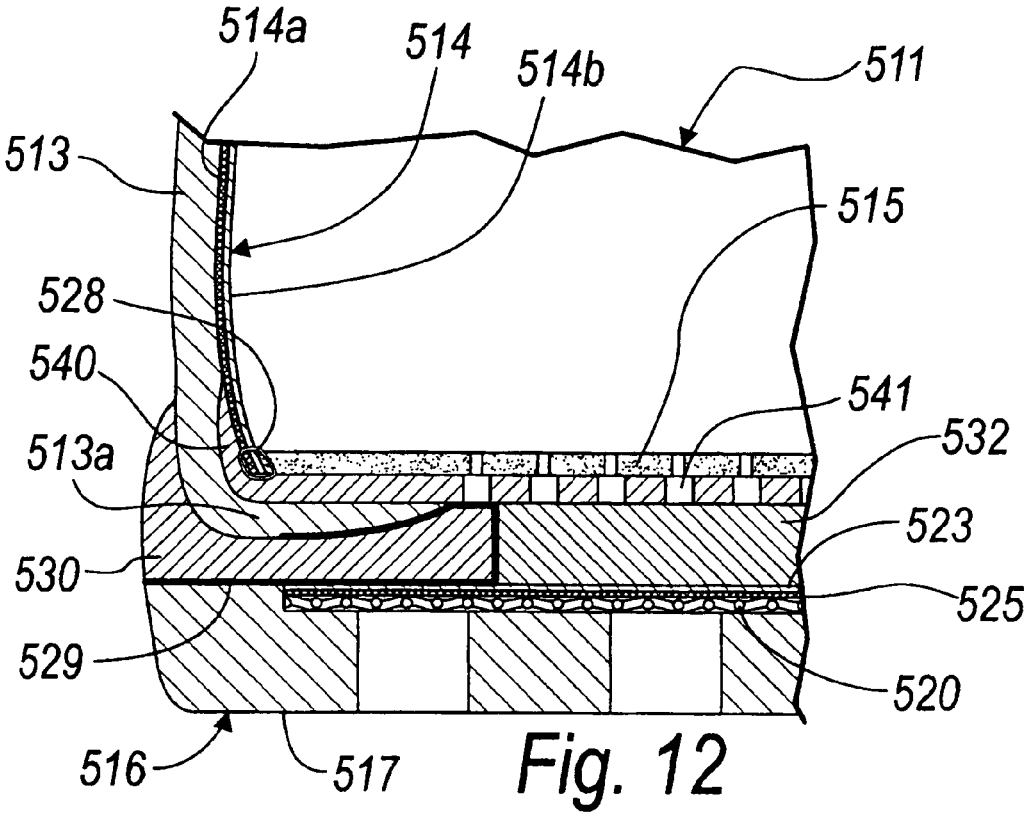
FIG. 12 is a schematic transverse sectional view of a portion of a completely waterproof and vapor-permeable shoe, according to the invention, which is a variation with respect to the embodiments of the preceding figures.

FIG. 12 illustrates another embodiment of a fully waterproof and vapor-permeable shoe according to the invention.

In this embodiment, the upper portion 511 is constituted by a vapor-permeable upper 513, a lining 514 and an insole 515, which is provided with through perforations.

The lining 514 is formed by an outer layer 514*a*, which is constituted by a waterproof and vapor-permeable membrane which is similar to the membrane of the preceding examples and is associated with a mesh, and by an inner vapor-permeable layer 514*b*, which is directed toward the foot insertion region.

The insole 515 is joined to the edges of the lining 514, for example by means of stitched seams 528, according to the construction commonly known as "strobel".

The upper portion 511 further comprises, below the insole 515, a waterproof inshoe 540, which is associated with the insole 515 and with the membrane of the lining 514 and is superimposed on the region that connects said insole 515 and said lining 514, so as to form a seal which straddles the perimetric stitched seam 528.

The upper 513 adheres to the inshoe 540 and its lower edge 513*a* is folded and glued under said inshoe.

Said waterproof inshoe 540 has suitable through holes 541 at the region of the sole meant for vapor permeation.

In other embodiments, the inshoe 540 can be a ring or a waterproof tape for providing a seal at the region for connection between the lining and the insole.

The sole 516, which is provided as described in the preceding examples and comprises the flat element 520, can be applied by adhesive bonding to the upper portion 511 or can be provided by overmolding on said upper portion 511.

For example, it is possible to provide the lower portion 517 of the sole by direct injection in a mold, together with the flat element 520 (as an alternative, the flat element can be assembled separately); subsequently, the protective layer 525, the membrane 523 and a vapor-permeable (or optionally perforated) filler element 532 are applied in a mold above the lower portion 517 with the flat element 520.

The upper portion 511 thus composed is fitted on a direct-injection last, placing the inshoe 540 in contact with the filler element 532, and a mid-sole 530 related to the perimetric portion of the sole 516 is overmolded, obtaining a seal 529 on the upper 513, the inshoe 540 and the membrane 523; in any case, the sole 516 is associated hermetically with the upper portion 511 only at the upper 513 and at the exposed portion of the inshoe 540 which is located between the upper 513 and the filler element 532, without affecting, or extending over, the central part intended for vapor permeation; this construction allows to avoid the flow of liquids within the foot insertion region through the lower edges 529 of the upper (in other embodiments, the lower portion 517 of the sole 516 and the mid-sole 530 are provided as a monolithic element).

Figure 13:
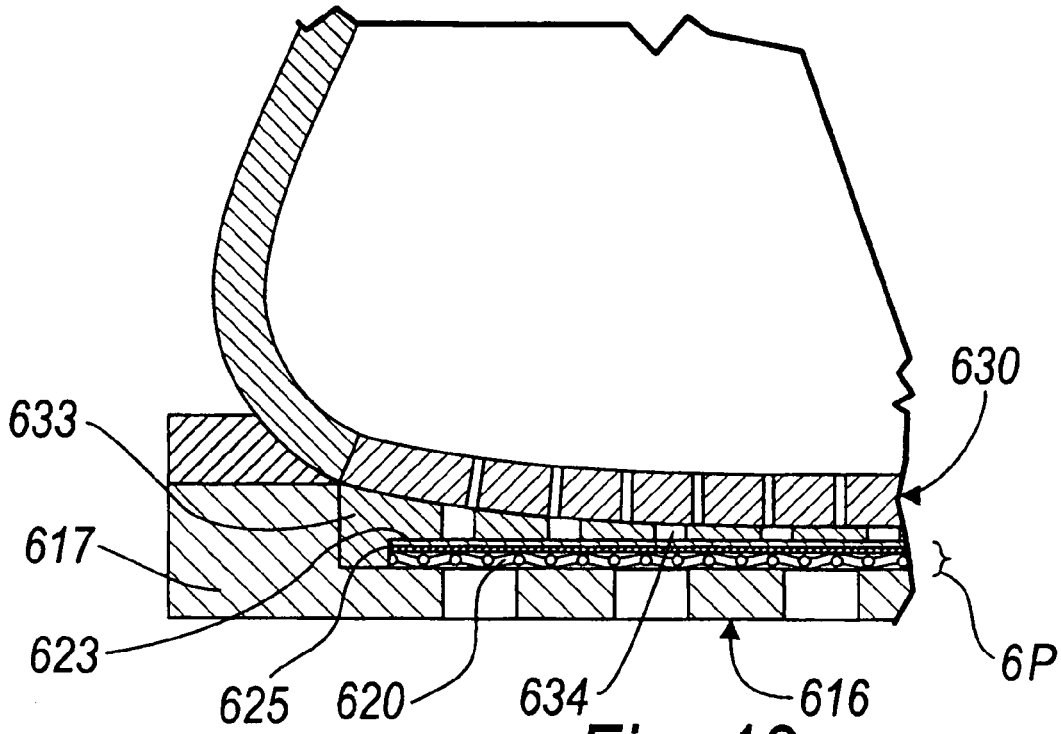
FIG. 13 is a schematic transverse sectional view of an embodiment of a shoe according to the invention which is a variation with respect to the embodiments of the preceding figures.

With particular reference to FIG. 13, an embodiment of a vapor-permeable shoe according to the invention comprises a sole 616, which is constituted by a diffusely perforated lower portion 617 and by a composite mid-sole 630 formed by a structural insert 633 made of waterproof plastic material provided diffusely with a plurality of through holes 634.

The lower face of said structural insert 633 is rigidly coupled to a pack 6P which comprises, from the bottom upwardly, respectively the flat element 620, the protective layer 625 and the membrane 623.

The membrane 623 is sealed perimetrically to the structural insert 633, and the insert is sealed perimetrically to the lower portion 617 of the sole 616.

The mid-sole is provided for example by overmolding on the pack 6P the structural insert 633.

As an alternative, it is possible to form within a mold the lower portion 617 of the sole 616, arrange thereon the pack 6P and then overmold the structural insert 633.

Figure 14:
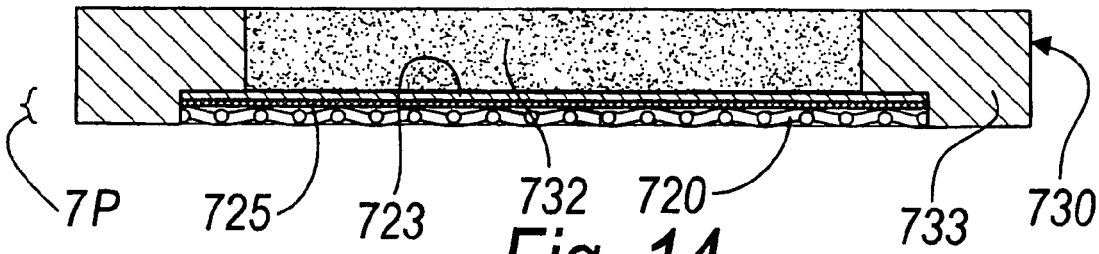
FIG. 14 is a schematic transverse sectional view of a mid-sole to be used in shoes having the structure according to the invention.

FIG. 14 illustrates a variation of the mid-sole 630 described above. In this variation, the structural insert 733 of the mid-sole 730 has only a perimetric extension, forming a central portion in which a vapor-permeable (or perforated) filler element 732 is to be arranged.

Figure 15:
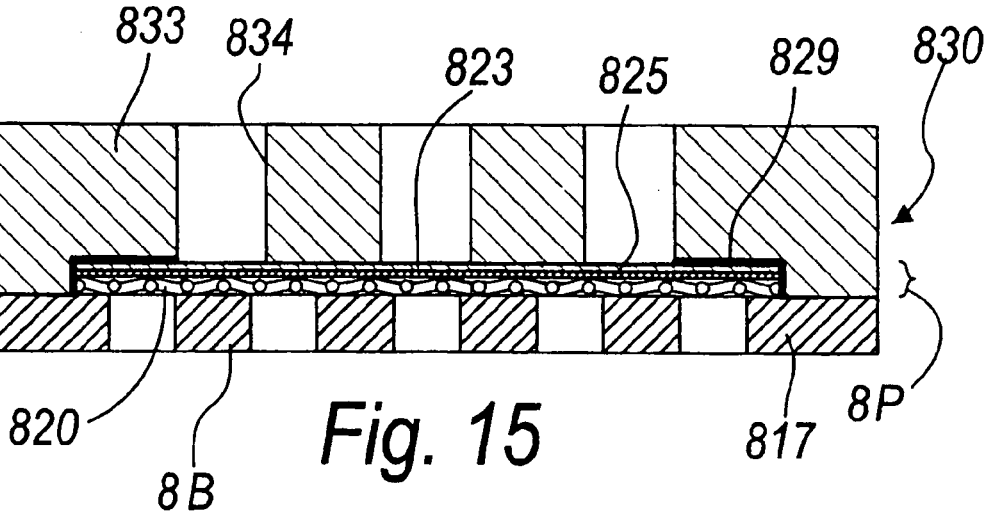
FIG. 15 is a schematic transverse sectional view of another mid-sole to be used in shoes having the structure according to the invention.
Figure 16:
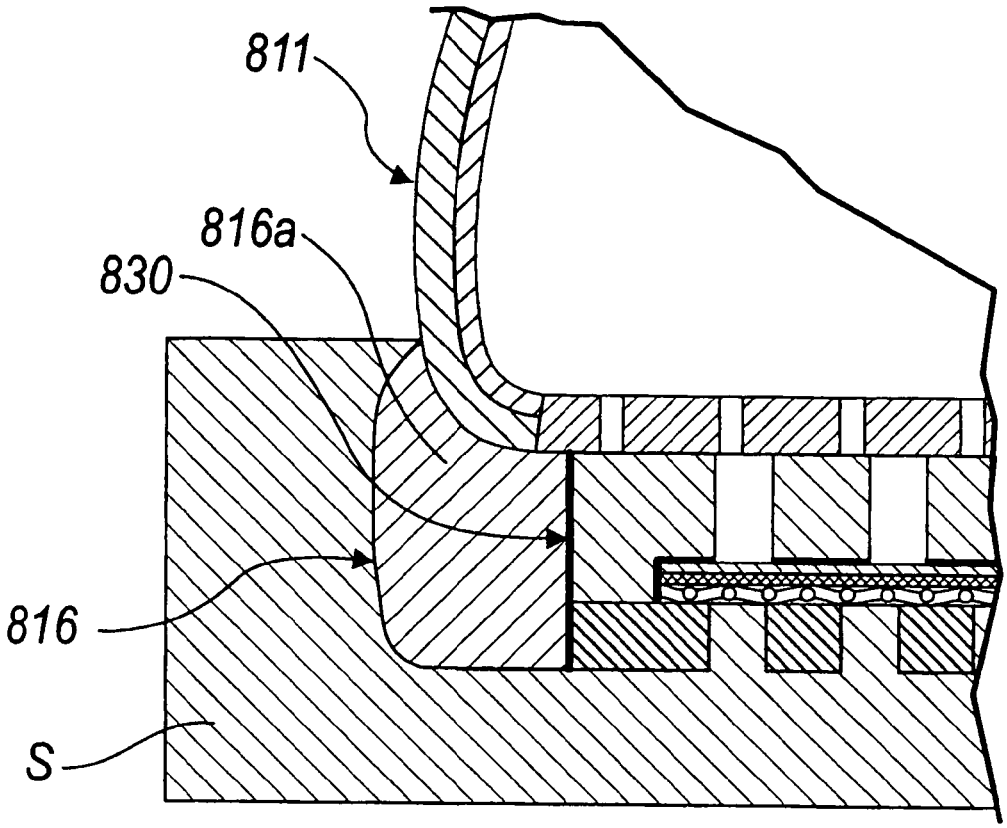
FIG. 16 is a schematic transverse sectional view of a mold for the injection of plastic material which shows internally a shoe, according to the invention, which uses the mid-sole of FIG. 15.
Figure 17:
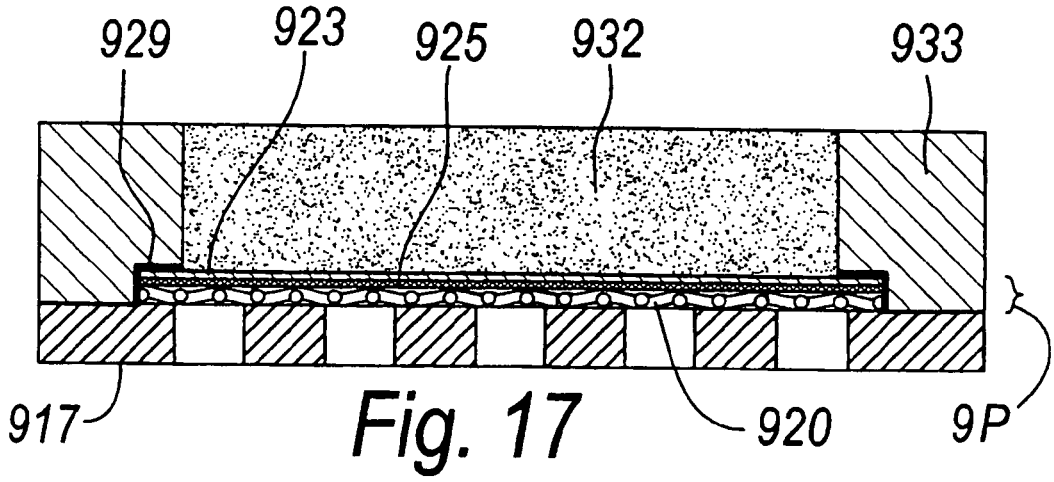
FIG. 17 is a schematic transverse sectional view of a variation of the mid-sole of FIG. 15.

FIGS. 15, 16 and 17 illustrate other variations of the mid-sole described above; in these variations, the lower portion of the sole on which the tread is formed is associated directly with the mid-sole.

In particular, FIG. 15 illustrates a mid-sole 830, which is constituted by a structural insert 833 which is provided diffusely with a plurality of through holes 834. A pack 8P is arranged at the lower face of said structural insert 833 at said through holes 834 and comprises, from the bottom upwardly, respectively the flat element 820, the protective layer 825 and the membrane 823; said pack 8P is arranged in a recess which is closed in a downward region by the lower portion 817 of the sole 816, which is diffusely perforated and on which a tread 8B is provided.

The seal 829 perimetrically with respect to the membrane 823 is provided for example by the adhesion of the plastic material of the structural insert 833 obtained by overmolding on said pack 8P (it can optionally be provided also by adhesive bonding).

FIG. 16 illustrates the step of the production of a shoe with said mid-sole 830 which also forms the lower portion 817 of the sole 816.

In practice, the perimetric portion 816*a* of the sole 816 is overmolded in a mold (designated by the letter S in the diagram) onto the upper portion 811 of the shoe; in this construction, the mid-sole 830, with the lower portion 817 of the sole 816 fixed thereto, is a mold insert.

FIG. 17 illustrates a variation of the mid-sole of FIG. 15.

This variation differs from the one of FIG. 15 in that the structural insert, now designated by 933, and the lower portion 917 of the sole with the tread formed therein, are provided as a monolithic element and incorporate internally a pack 9P which is formed by the flat element 920, the protective layer 925 and the membrane 923.

The seal 929 perimetrically with respect to the membrane 923 is provided by the adhesion of the plastic material of the structural insert 933 and the lower portion 917 obtained by overmolding on said pack.

Instead of the through holes, the structural insert 933 is provided, above the membrane 923, with a through portion in which a vapor-permeable (or optionally perforated) filler material 932 is arranged.

In practice it has been found that the invention thus described achieves the intended aim and objects.

The provision of through holes on the sole of the shoe which are much larger than the ones currently used in known types of shoes in fact allows to have optimum perspiration of the sole of the foot.

This enlargement of the holes with respect to those of currently known waterproof and vapor-permeable shoes is allowed by the introduction of the vapor-permeable or perforated flat element arranged directly above said through holes and rigidly coupled to the lower portion of the sole on which the tread is formed (or rigidly coupled).

Said flat element allows to maintain a substantially uniform arrangement of the foot supporting surface without forming hollows due to the presence of large holes.

Said element also allows to protect the membrane against piercing by blunt objects and debris which might be trodden upon accidentally and can enter the through holes of the sole.

The invention thus conceived is susceptible of numerous modifications and variations, all of which are within the scope of the appended claims; all the details may further be replaced with other technically equivalent elements.

In practice, the materials used, so long as they are compatible with the specific use, as well as the dimensions, may be any according to requirements and to the state of the art.

The disclosures in Italian Patent Application No. PD2006A000274 from which this application claims priority are incorporated herein by reference.

Where technical features mentioned in any claim are followed by reference signs, those reference signs have been included for the sole purpose of increasing the intelligibility of the claims and accordingly, such reference signs do not have any limiting effect on the interpretation of each element identified by way of example by such reference signs.

The invention claimed is:

1. A waterproof vapor-permeable shoe, comprising:

an upper portion, which delimits a foot insertion region;

a sole, made mainly of plastic material, which is provided with at least one region which is diffusely perforated with through holes in the direction of a walking surface;

a vapor-permeable or perforated flat element, which is rigidly coupled to a lower portion of said sole on which the tread of said sole is formed or rigidly coupled, said flat element being arranged so as to overlap directly said at least one diffusely perforated region and being adapted to limit the formation of hollows in the foot insertion region at the projection of the holes of said at least one diffusely perforated region;

a waterproof vapor-permeable membrane, which is associated with said upper portion and/or with said sole, is arranged above said flat element so as to be superimposed on said at least one diffusely perforated region, and is joined hermetically along its perimeter to the portion of shoe that surrounds said membrane so as to avoid the rise of liquid from said at least one diffusely perforated region and along the perimetric edge of said membrane within the foot insertion region, means for protection against piercing being associated with said membrane and comprising at least said flat element, wherein said upper portion is composed of a vapor-permeable or perforated upper, which is associated with a lining which is likewise vapor-permeable or perforated, and a vapor-permeable or perforated insole, below which said membrane is fixed, said insole, with said membrane being sewn perimetrically to the edges of the assembly constituted by the upper and the lining, the perimetric seal of said membrane being superimposed on the region that connects said upper and said lining with said insole provided with said membrane, wherein said perimetric seal is constituted by plastic material which is overmolded on said upper portion providing at least part of said sole, wherein said flat element is adapted for use as a mold insert such as to be incorporated within the sole during the injection thereof onto the upper portion, wherein said flat element has a net-like structure made of a material which is resistant to hydrolysis, and wherein said means for protection against piercing comprise a protective layer which is arranged between said flat element and said membrane.

2. The shoe according to claim 1, wherein the area of the holes of said at least one diffusely perforated region ranges from approximately 19.5 and 315 $mm^2$.

3. The shoe according to claim 1, wherein said flat element is constituted by a microstretched metal plate, or by a layer of leather, or by a fabric made of natural or synthetic or metallic fibers.

4. The shoe according to claim 1, wherein said protective layer is narrower than said membrane, the edges of said protective layer being internal to the contour of said membrane.

5. The shoe according to claim 1, wherein said perimetric seal constitutes the means for the adhesion of said sole to said upper portion and is formed by a perimetric layer of adhesive or by a film of PVC or PU which is melted by high-frequency welding.

6. The shoe according to claim 1, wherein said overmolded plastic material that constitutes the perimetric seal of said membrane forms said lower portion of said sole on which said tread is formed or rigidly coupled.

* * * * *